United States Patent [19]

Maccise

[11] 4,266,684

[45] May 12, 1981

[54] JUG WITH SUGAR BOWL, COFFEE POT AND CUPS

[76] Inventor: Yamil A. Maccise, Ciudad Satélite, México City, Mexico

[21] Appl. No.: 18,554

[22] Filed: Mar. 8, 1979

[51] Int. Cl.[3] ..... B65D 21/02

[52] U.S. Cl. ..... 220/23.83; 220/40; 220/23.6; 220/23.86; D7/77; 222/130

[58] Field of Search ..... 220/4 C, 4 D, 23.6, 220/23.83, 23.86; 222/130; D7/3, 4, 19, 20, 21, 59, 60, 71, 77

[56] References Cited

U.S. PATENT DOCUMENTS

| | | | |
|---|---|---|---|
| D. 194,636 | 2/1963 | Conkle | D7/77 |
| 304,805 | 9/1884 | Doutteil | 220/23.83 |
| 1,065,633 | 6/1913 | Stone | 220/4 D |
| 1,451,146 | 4/1923 | Fate | 220/4 D |
| 2,257,569 | 9/1941 | McCarthy | 220/23.83 |
| 2,449,129 | 9/1948 | Kolehmainen | 220/4 D |
| 2,883,082 | 4/1959 | Schlambohm | D7/77 |
| 3,844,450 | 9/1974 | Johnson | D7/77 |
| 3,952,906 | 4/1976 | Georgopulos | 220/236 |

*Primary Examiner*—George E. Lowrance
*Attorney, Agent, or Firm*—Ladas & Parry

[57] ABSTRACT

Set of jug, sugar bowl, coffee container and cups capable of being assembled into a single unit by attaching the bowl, container and cups to the jug.

3 Claims, 6 Drawing Figures

JUG WITH SUGAR BOWL, COFFEE POT AND CUPS

BRIEF DESCRIPTION OF THE INVENTION

The present invention refers to household items in general an in particular to a practical jug, sugar bowl, coffee container and cup set, capable of forming one single demountable assembly in which the jug's handle is used to support the sugar bowl, coffee container and cups by their handles. In addition, a support strip may be attached to two projections located on the jug's handle to permit the carrying of the complete set. The cups each have an annular recess around its base, whereby they can be stacked with the recess located in the top of the next cup down in the stack.

BACKGROUND OF THE INVENTION

The transport or moving of table and camping items such as jugs, glasses and cups is cumbersome and generally requires the use of a basket or similar facilities, the storage of which additionally utilizes space in pantries and closets.

SUMMARY OF THE INVENTION

An object of this invention is to provide an assembly composed of a jug, sugar bowl, coffee container and set of cups in which the handle of the jug, fixed on one of its sides, serves as a support for sugar bowl, coffee container and cups by means of two parallel rails. The sugar bowl, coffee container and cups are attached to the jug by their own handles, and preferably have an annular recess around the bottom end that fits into the top end of the next cup.

There is a projection at the top end of the parallel rails where a strip of flexible thermoplastic polymeric material is attached to form a handle to carry the set.

DESCRIPTION OF THE FIGURES

The invention will now be described, by way of example, with reference to the accompanying drawings, in which.

DETAILED DESCRIPTION OF THE INVENTION

Figure 1:
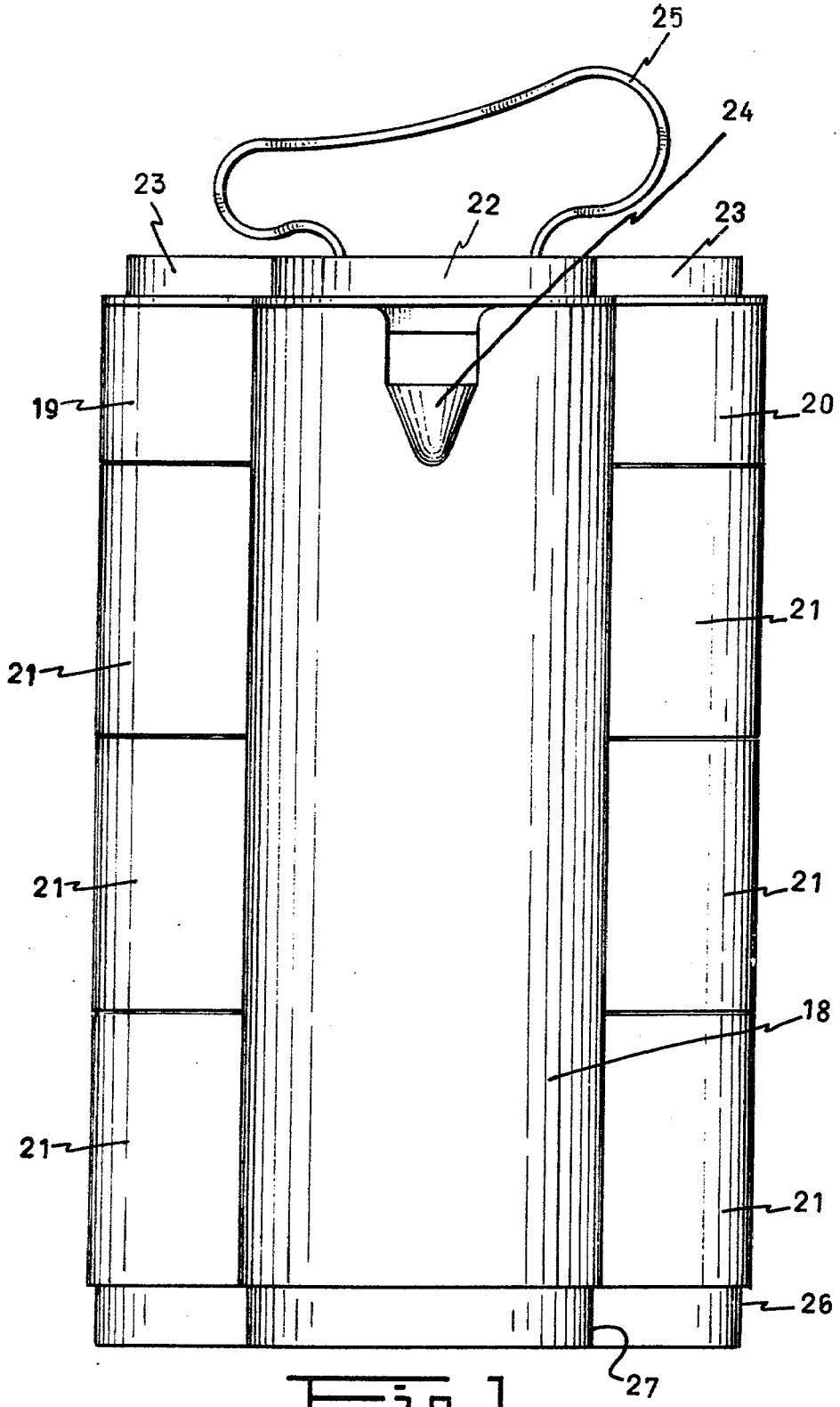
FIG. 1 is a front view of the jug, sugar bowl, coffee container and cups, forming the set, the subject of this invention.
Figure 2:
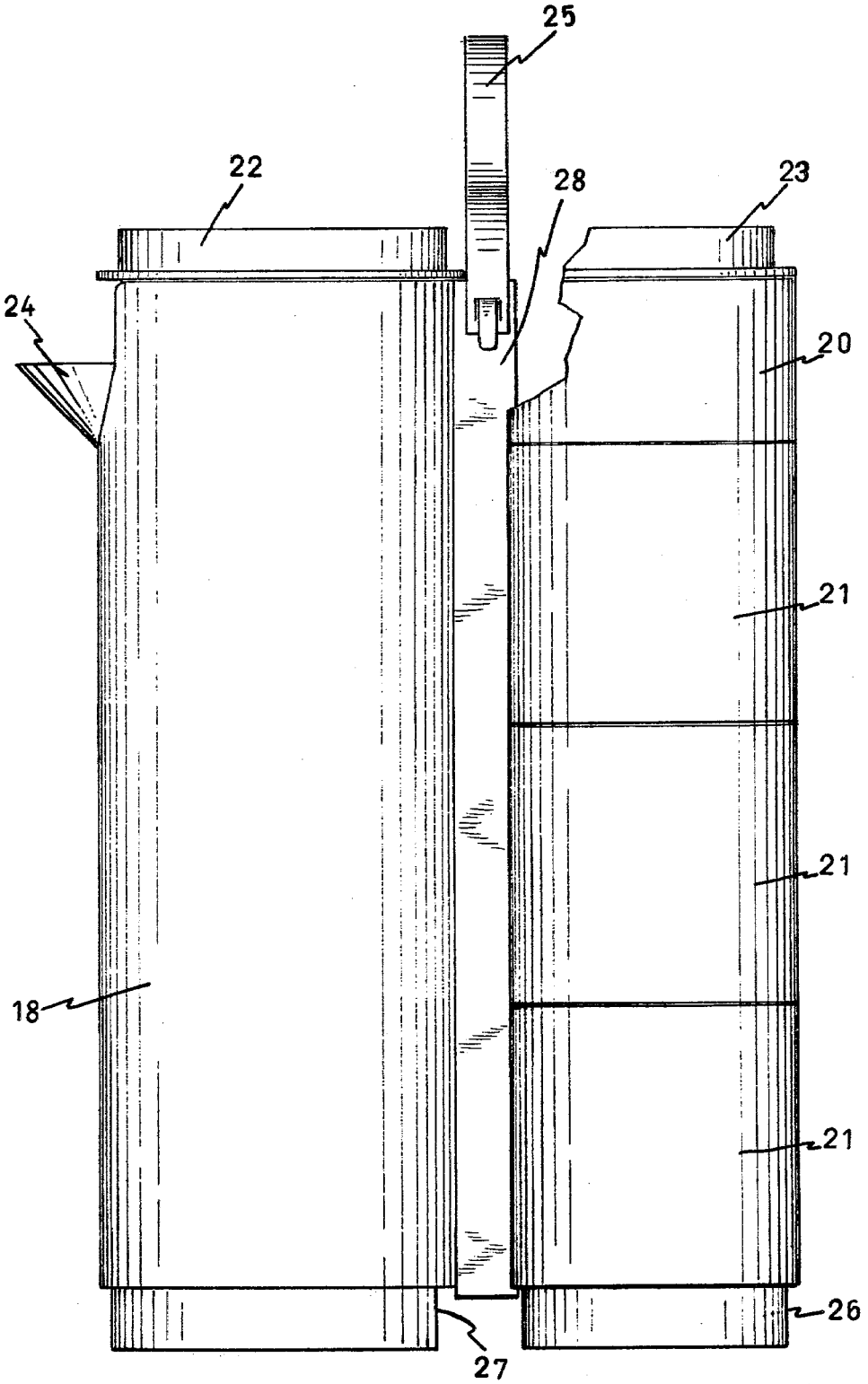
FIG. 2 is a partially cut away side view of the set shown in FIG. 1.
Figure 3:
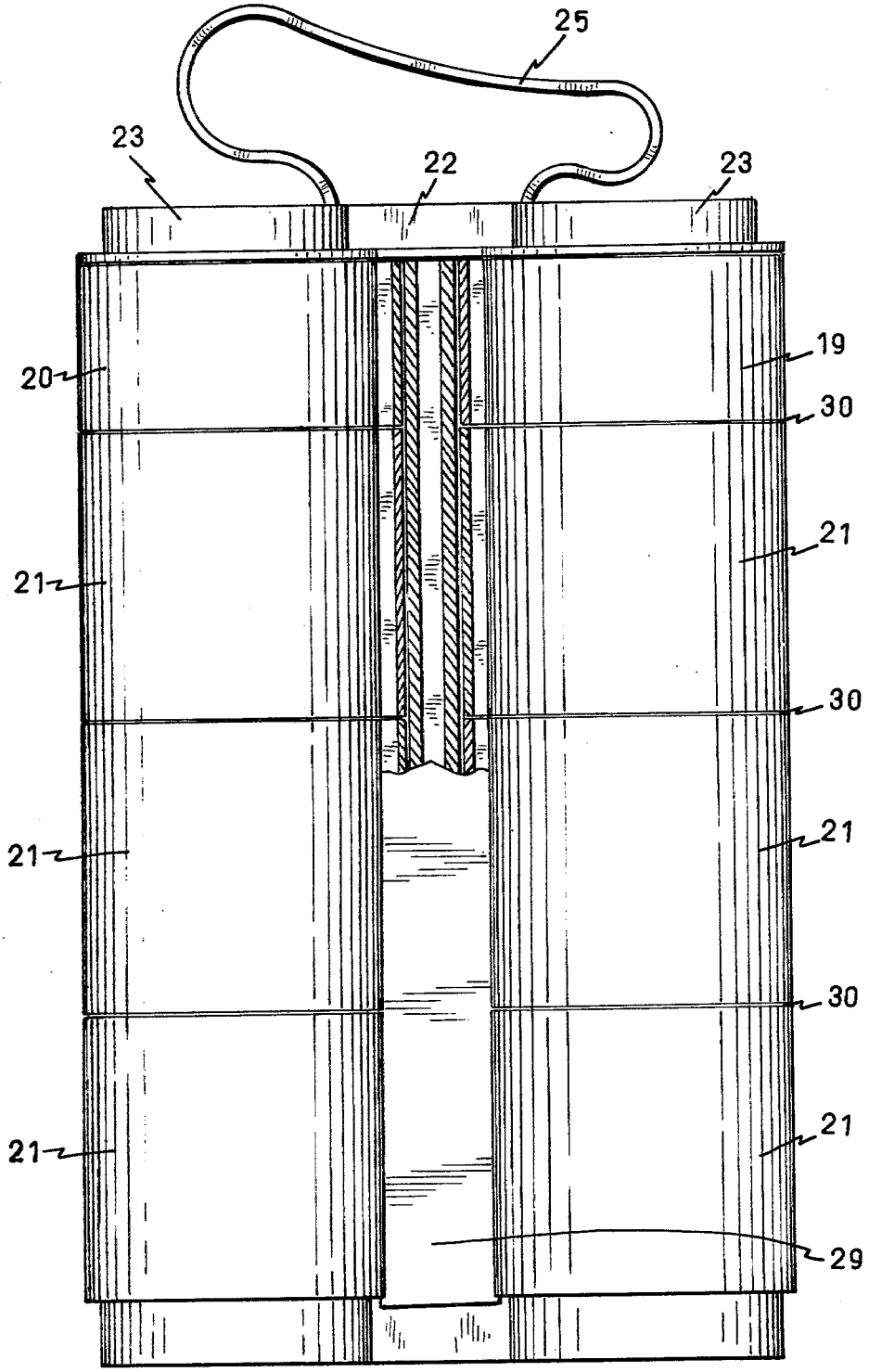
FIG. 3 is a partially sectioned rear view of the set shown in FIG. 1, the sectioned portion being on section line 3—3 of FIG. 4.
Figure 4:
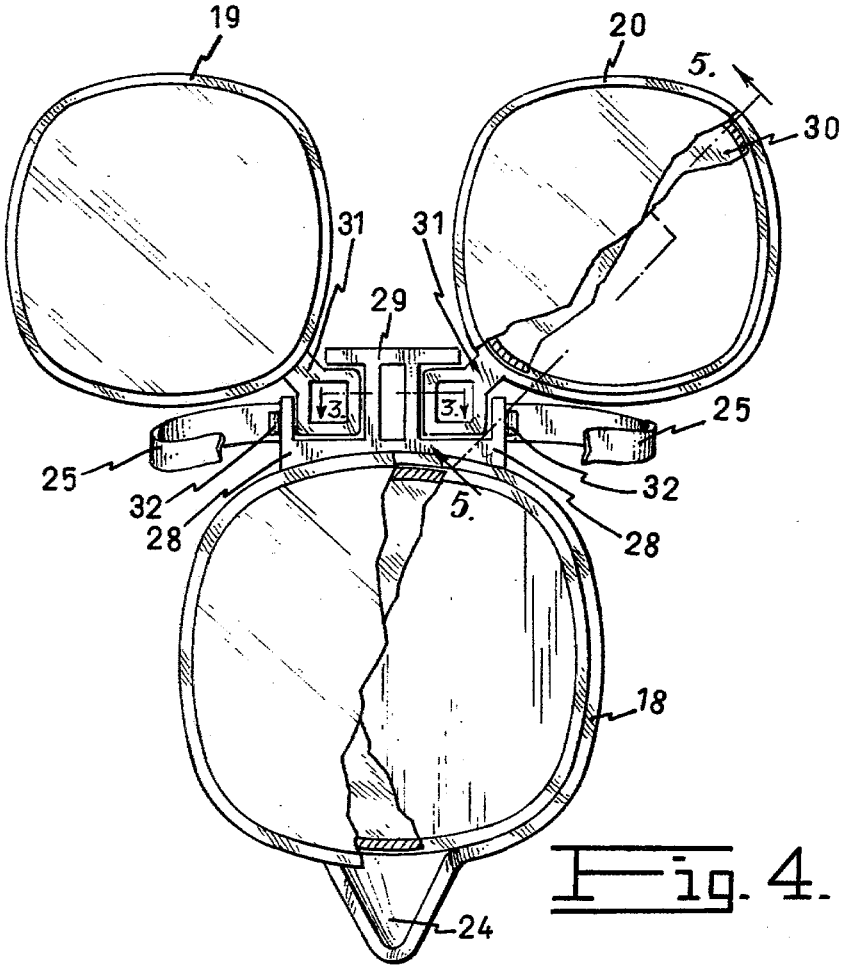
FIG. 4 is a plan view of the set shown in FIG. 1.
Figure 5:
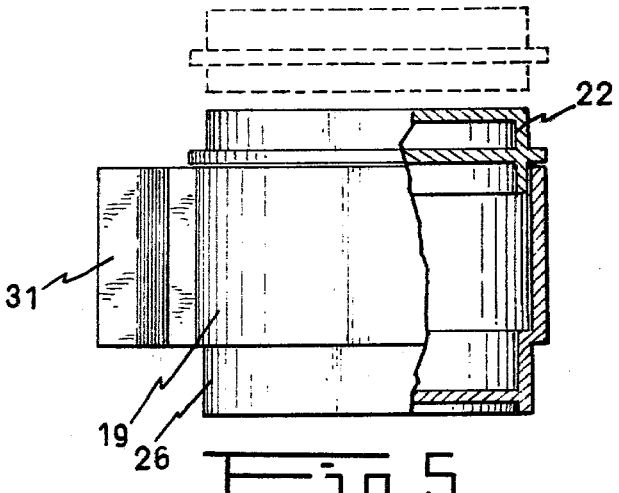
FIG. 5 is a high side view of the sugar bowl or coffee container with closure.
Figure 6:
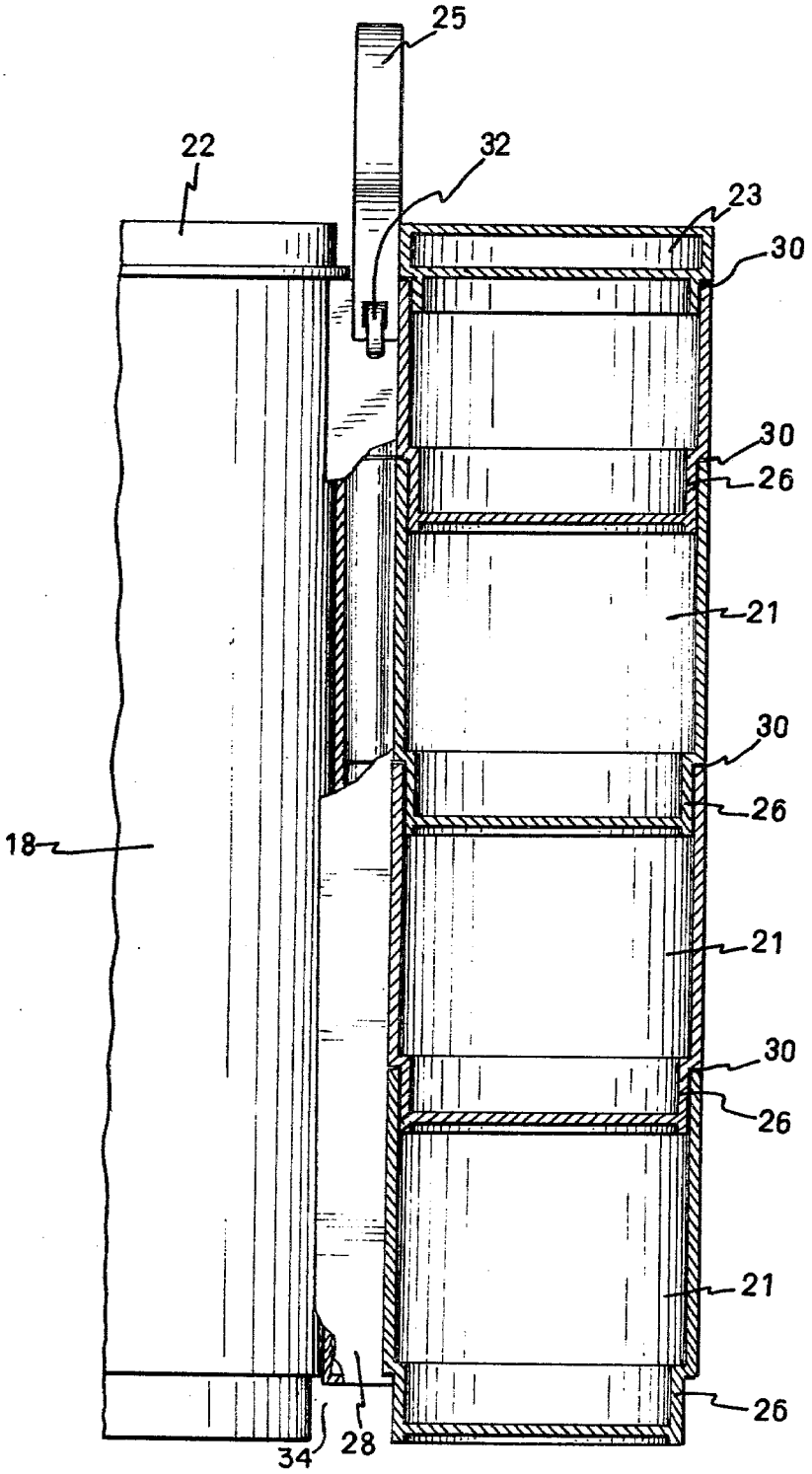
FIG. 6 is a part sectional side view on line 5—5 shown in FIG. 4 of the cup set assembled to the jug and showing the manner in which they fit into each other.

The present invention consists of cups (21), sugar bowl (19) and coffee container (20) attached to a jug

(18), with the jug (18), the sugar bowl (19) and the coffee container (20) being provided with tops (22) and (23) respectively. The front part of the jug is provided with a spout (24). The top rear of the jug is provided with projections attached to which is a carrying handle (25). The cups (21) and the jug (18) are provided, at their lower ends with annular recesses (27) and (26).

There is a vertically disposed pairs of rails (28) on the rear of the jug (18) and with a vertically disposed "T" cross section bar (29) symmetrically intermediate these rails.

There is an opening (30) in the top of each cup (21), sugar bowl (19) and coffee container (20) to receive the annular recess of another cup (26) or, in the case of the bowl and container, the tops (23). Rails (28) and crossbar (29) form a vertically disposed partially closed recess in which handles (31) of cups (21), bowl (19) and container (20), are captively held. The rails (28) have two depending hook-like projections (32) to which the band (25) that serves as a handle for the unit is attached.

A base portion (34) closes the bottom of the partially closed recess.

Crossbar (29) forms a natural handle for the jug (18) and together with the rails (28) is a support for the handles (31) of cups (21), sugar bowl (19) and coffee container (20), the items being inserted downwardly into the partially closed recess for attachment to the jug.

The foregoing disclosure of specific embodiments is illustrative of the broad inventive concepts comprehended by the invention.

What I claim is:

1. In combination, a jug and a set of additional containers comprising cups, a sugar bowl and a coffee container, the jug having vertical parallel longitudinal rails located on the exterior thereof, and a vertical crossbar of "T"-shaped cross-section, positioned between said rails and defining with said rails a pair of vertical slots which provide access to respective recesses, each container of said set having a handle which has a neck portion and a head portion, said head portion being configured for captive retention in one of said recesses with said neck portion located in the slot which provides access to said one recess, and each container of said set having a top opening and having an annular recess at its lower end arranged to fit into and close the top opening of another container of the set.

2. A set according to claim 1, wherein there are two hook-like projections on the upper part of the parallel longitudinal rails and a band, that serves as the handle for the whole set, is attached to said projections.

3. A set according to claim 1, wherein the cup, sugar bowl and coffee container handles take the same geometric pattern of the recess formed by the parallel longitudinal rails and the "T" crossbar, the cups, sugar bowl, and coffee container fit one over the other by means of the annular recess in their lower ends, and the cups, sugar bowl and coffee container are assembled to the jug by their handles in the recess formed by the parallel longitudinal rails and the "T" shaped crossbar.

* * * * *